United States Patent [19]

Iseli

[11] 4,317,572

[45] Mar. 2, 1982

[54] FIRING BUTT INCLUDING A HOUSING FOR A TARGET

[75] Inventor: Gottfried Iseli, Nunningen, Switzerland

[73] Assignee: Laspo AG, Diessenhofen, Switzerland

[21] Appl. No.: 103,523

[22] Filed: Dec. 13, 1979

[51] Int. Cl.[3] ..... F41J 1/10; F41J 7/00

[52] U.S. Cl. ..... 273/406; 273/404; 273/408

[58] Field of Search ..... 273/403, 404, 406, 407, 273/408, 391, 392

[56] References Cited

U.S. PATENT DOCUMENTS 84,228 11/1868 Stein ..... 273/392 X 1,981,293 11/1934 Varrelman ..... 273/406 X 2,535,280 12/1950 Gartrell ..... 273/404

FOREIGN PATENT DOCUMENTS 618555 4/1936 Fed. Rep. of Germany ..... 273/408

*Primary Examiner*—Anton O. Oechsle

*Attorney, Agent, or Firm*—Young & Thompson

[57] ABSTRACT

A firing butt includes a frame-like housing (1) for a target (4) with a main aperture (5) in which the target is located. A protective frame (9) overlies the housing in the direction of fire and is arranged to catch a bullet. In each case the frame (9) includes a steel plate and an elastomeric layer on the side of the steel plate remote from the housing. The elastomeric layer (16) and steel plate (15) are spaced apart and the intervening space may be filled with a layer of sand (3). The elastomeric layer may be carried on a steel plate (16*a*).

16 Claims, 6 Drawing Figures

FIRING BUTT INCLUDING A HOUSING FOR A TARGET

The invention relates to a target firing butt comprising a frame-like housing to accommodate a target.

Such butts are well-known, and one of the disadvantages is that they are usually installed in an enclosed trench and have to be made ready by markers at the butts prior to target practice. These procedures are not only rather complicated, but the requirements for marker personnel are labour and cost-intensive.

It is an object of the invention to provide and improved firing butt which will overcome some of the existing problems. In a preferred form of the invention the butt is designed to be permanently installed and operated by remote control.

As the target is enclosed in a framelike housing, the butt lends itself to permanent installation. The aperture in the housing can be closed by remote control. The protective metal frame, designed to catch projectiles and facing the direction of fire in front of the housing, reduces the risk of the housing being damaged by projectiles.

The protective frame preferably includes an overlying plate or layer of elastomeric material such as rubber. Any projectiles hitting the metal plate of the frame will therefore be already decelerated by the rubber layer to such an extent that splintering or deflection of the projectile is reduced or eliminated. It is of advantage to space the metal plate from the elastomeric material so that any projectiles splintering on impact with the steel plate will be trapped in the intervening hollow space. The deceleration of projectiles or the trapping of any projectile splinters can be improved by providing sand between the metal plate and the elastomeric material.

It is of especial advantage to provide a space between the protective frame and the housing since the separation impedes the transmission of vibrations caused by projectiles striking the protective frame. Thus the equipment accommodated in the housing is effectively protected against serious vibration, thereby reducing the risk of damage and malfunction.

Figure 2:
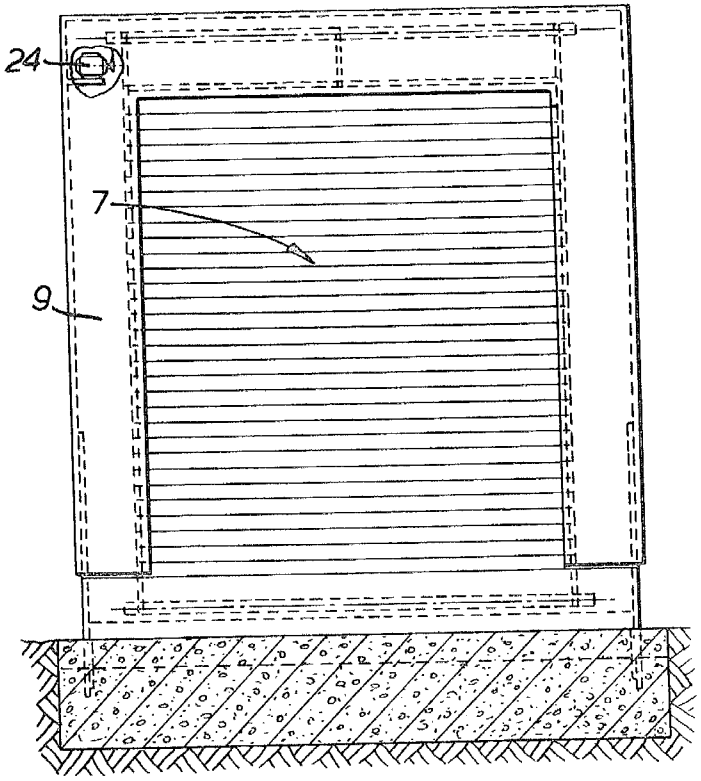
Figure 1:
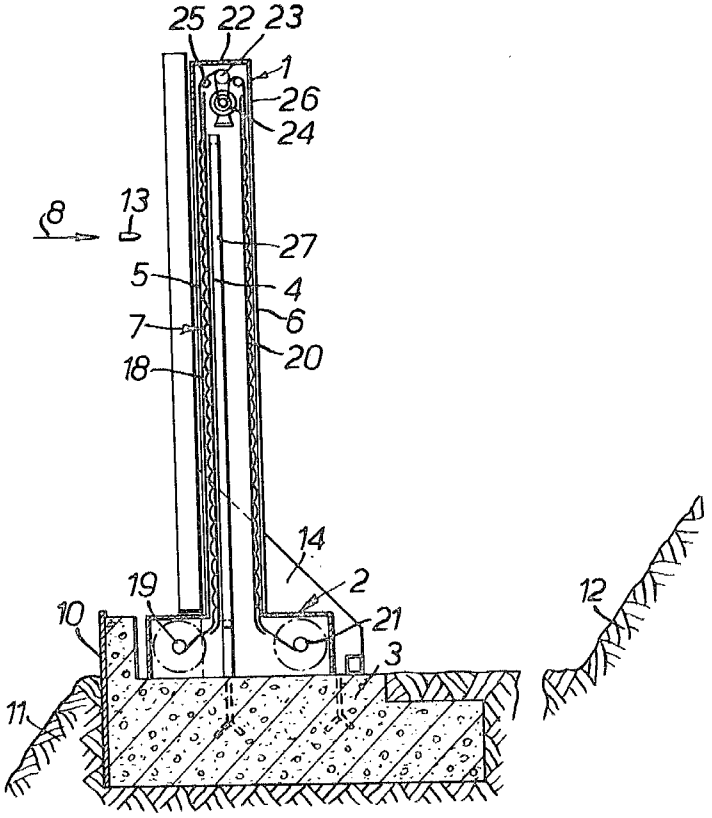
Figure 4:
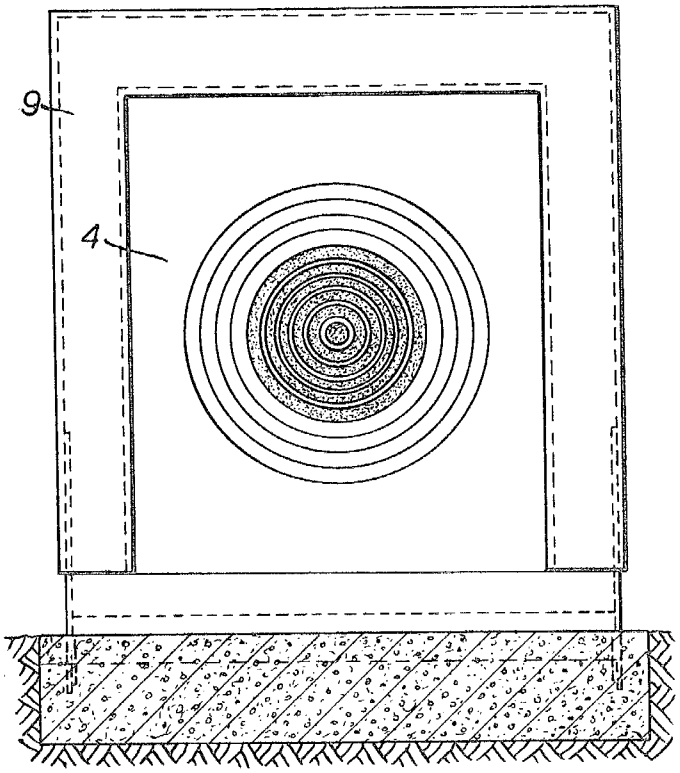
Figure 3:
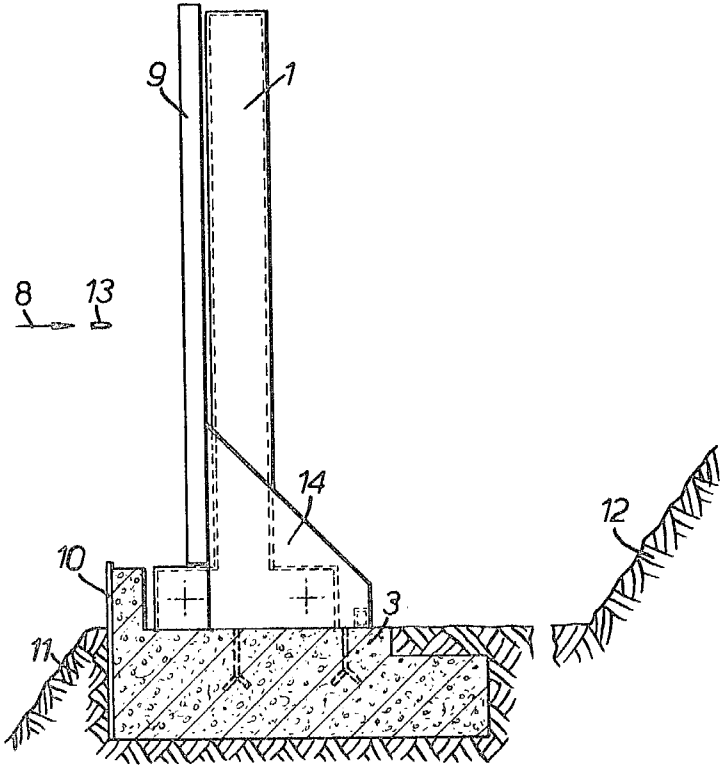
Figure 6:
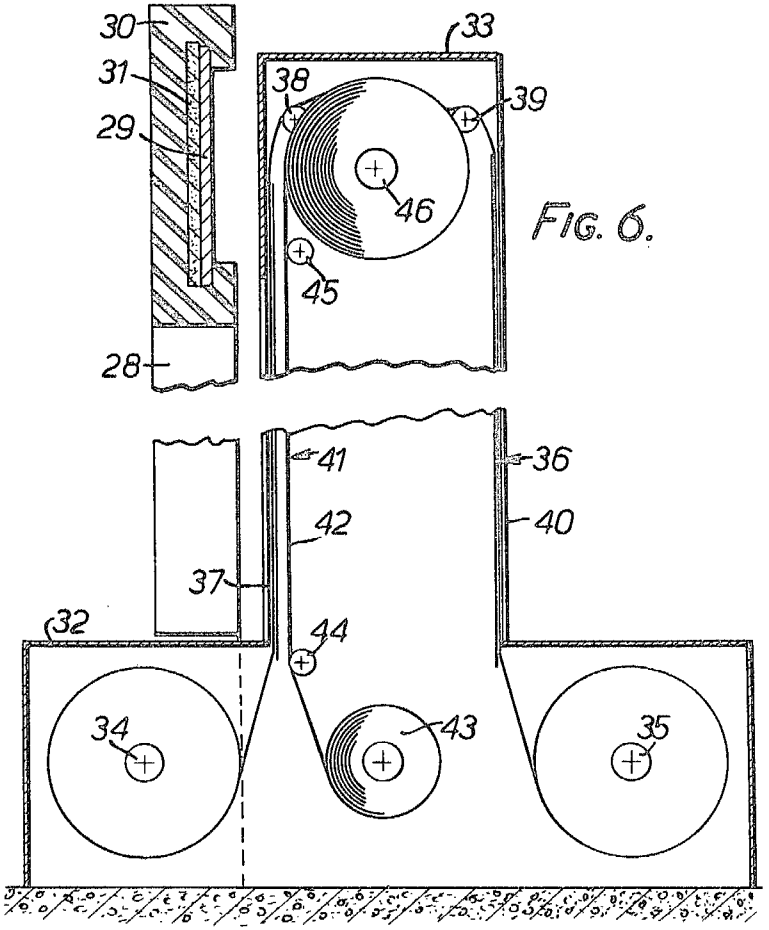
Figure 5:
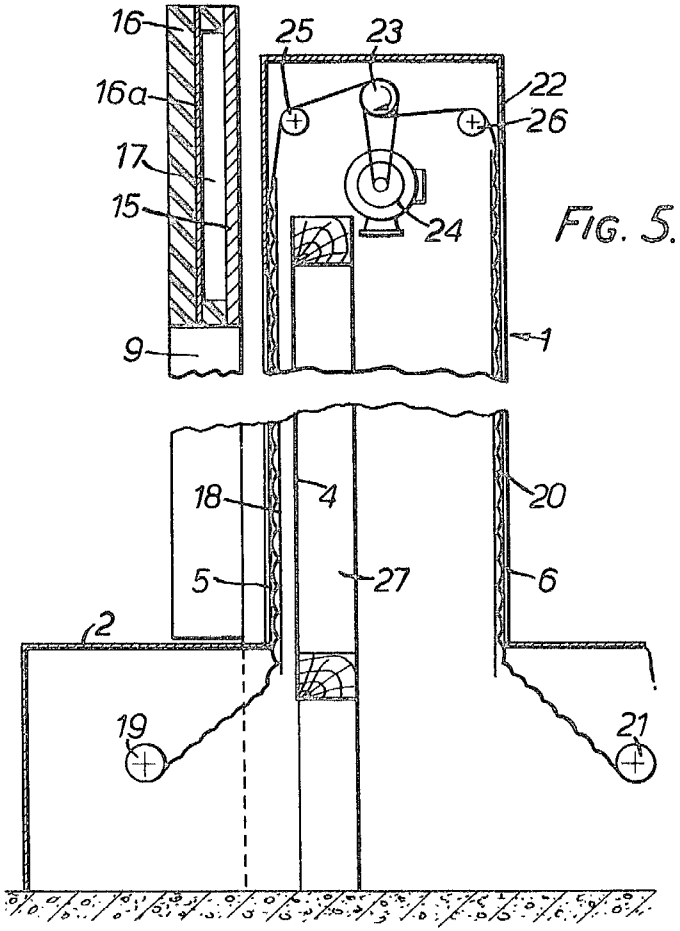

The invention may be performed in various ways and several embodiments will now be described by way of example with reference to the accompanying drawings, in which:

FIG. 1 is a sectional side elevation of a firing butt according to the invention, with roller shutter closed, FIG. 2 is a front elevation of the butt illustrated in FIG. 1, FIG. 3 is a sectional side elevation of the butt with the shutter opened, FIG. 4 is a front elevation of the butt as illustrated in FIG. 3, FIG. 5 is a detailed sectional side elevation of the butt as illustrated in FIG. 1, on an enlarged scale, and FIG. 6 is a detailed sectional side elevation of a modified butt design.

The firing butt or target mechanism illustrated in FIGS. 1 to 5 comprises a frame-like housing 1 whose box-type base 2 is anchored to a foundation 3. The housing contains and supports a target 4. A front aperture 5 and a rear aperture 6 in the housing 1 are closed by a roller shutter 7.

The housing 1 is covered by a steel-plate frame 9, facing the direction of fire to catch a bullet or other projectile as shown at 13. Located in front of the foundation 3 and facing the direction of fire is a steel plate 10 against which earth 11 is heaped to catch the projectiles 13. At the rear of the butt is a mound of earth 12 also to catch any projectiles 13 which may penetrate the butt.

As illustrated particularly in FIGS. 1, 3 and 5, a free space is provided between the steel-plate frame 9 and the frame-like housing 1, the frame 9 being anchored to the foundation 3 through a pair of supports 14. As shown in FIG. 5, the steel-plate frame 9 comprises a steel plate 15 having a rubber plate 16 together with a plate **16*a* attached thereto on the opposite side to the housing 1, the rubber plate 16 being designed and constructed to reclose after penetration by a projectile 13. A hollow space 17 is provided between the steel plate 16*a*. Initially, the rubber plate 16 and the plate 16*a* serve to decelerate a projectile 13 and trap any projectile splinters after impact on the steel plate 15**.

The roller shutter 7 consists of a front part 18 and a rear part 20: the front part 18 is associated with the front aperture 5, being wound onto a front winding mandrel 19 mounted in the housing base 2; the rear part 20 is associated with the rear aperture 6, being wound onto a rear winding mandrel 21 mounted also in the housing base 2. Located in the top horizontal frame element or head 22 of the frame-like housing 1 is a winding mandrel 23 for the simultaneous take-up of the front and rear parts 18, 20 of the roller shutter 7. The winding mandrel 23 is driven by a drive motor 24, the front and rear parts 18, 20 of the roller shutter being guided onto it by guide rolls 25 and 26.

The target 4 is securely held in a frame 27 within the housing 1. The butt is also equipped with an automatic scoring system, but no detailed illustrations of that are necessary.

FIG. 6 shows a slightly modified butt design. The steel-plate frame 28 is provided with a steel plate 29 having a rubber plate 30 on the side towards the direction of fire. A layer of sand 31 is provided between the steel plate 29 and the rubber plate 30. The rubber plate 30 and the layer of sand 31 serve to decelerate any projectiles 13 and trap any splinters.

Sited in the box-type housing base 32 of the frame-like housing 33 are a front winding mandrel 34 and a rear winding mandrel 35 for the roller shutter 36. The roller shutter 36 is wound from the front winding mandrel 34 on to the rear winding mandrel 35, passing across the front aperture 37, the top guide rolls 38, 39 and the rear aperture 40 in its path. A drive mechanism details of which are not necessary, serves to operate by remote control the winding mandrels 34, 35.

Also accommodated in the frame-like housing 33 is a target 41, which is in the form of a flexible target band 42, that can be wound up or drawn off a spool. The target band 42 is supplied from a bottom magazine roll 43 via a bottom guide roll 44 and a top guide roll 45 and taken up by a top winding mandrel 46. A drive mechanism not illustrated in detail is arranged to operate by remote control the winding mandrel 46 for the target band 42.

Also accommodated in the housing 33 is an automatic scoring system, not illustrated in detail.

As illustrated in these examples, all butt functions can be remote-controlled from the firing position, and the results are automatically transmitted to the firing position. Thus the butt can operate without the need for marker personnel at the butt.

I claim:

1. A firing butt comprising a frame-like housing for a target with a main aperture in which the target is located and through which a projectile can penetrate the target and a protective frame including a first metal plate overlying the housing in the direction of fire to receive the impact of projections, a further plate or layer of elastomeric material which is constructed to close up automatically after penetration by a projectile, and a second metal plate carrying the elastomeric layer, said second metal plate and said elastomeric layer overlying said first metal plate in the direction of fire, the metal plates defining a space between them.

2. A firing butt comprising a frame-like housing for a target with a main aperture in which the target is located and through which a projectile can penetrate the target and a protective frame including a metal plate overlying the housing in the direction of fire to receive the impact of projectiles, a layer of elastomeric material and a layer of sand between the metal plate and the elastomeric material.

3. A firing butt comprising a frame-like housing for a target having a main aperture in which the target is located and through which the projectile can penetrate the target and including a remote controlled roller shutter to close the aperture from the front and rear; and a protective frame formed at least partly of metal plate overlying the housing in the direction of fire to receive the impact of projectiles.

4. A firing butt according to claim 3, in which the protective frame includes a metal plate and a further plate or layer of elastomeric material on the side thereof remote from the housing.

5. A firing butt according to claim 4 or claim 2, in which the elastomeric material is constructed to close up automatically after penetration by a projectile.

6. A firing butt according to claim 4, in which the metal plate of the protective frame is spaced from the elastomeric material, 7. A firing butt according to claim 1 or claim 3, including a layer of sand between the metal plate and the elastomeric material.

8. A firing butt according to any one of claims 1, 2 or 3, in which the protective frame is spaced from the housing.

9. A firing butt according to claim 8, in which the protective frame is supported and anchored independently of the housing.

10. A firing butt according to claim 1, in which the housing is formed with a main aperture in which the target is located and through which a projectile can penetrate the target, and including a remote controlled roller shutter to close the aperture from the front and rear.

11. A firing butt according to claim 10 in which the target is in the form of a flexible band carried by a winding mechanism.

12. A firing butt according to claim 3 including a winding mandrel in the top part of the housing for winding both front and back parts of the roller shutter.

13. A firing butt according to claim 3, including two winding mandrels for the roller shutter, which runs from one winding mandrel, across the front of the aperture in the housing over a top guide roll, and across the back of the aperture in the housing, to the other winding mandrel.

14. A firing butt according to claim 1 or claim 2, including means for mounting the target in the housing.

15. A firing butt according to claim 1, in which the target is in the form of a flexible band carried by a winding mechanism.

16. A firing butt according to claim 1 or claim 2 in which the further plate or layer of an elastomeric material lies on the side of the metal plate which is remote from the housing.

* * * * *